US009302809B1

(12) United States Patent
Hooper

(10) Patent No.: US 9,302,809 B1
(45) Date of Patent: Apr. 5, 2016

(54) STACKABLE, STABILIZED FUEL CONTAINERS

(71) Applicant: Timothy W. Hooper, Bentonville, AR (US)

(72) Inventor: Timothy W. Hooper, Bentonville, AR (US)

( * ) Notice: Subject to any disclaimer, the term of this patent is extended or adjusted under 35 U.S.C. 154(b) by 0 days.

(21) Appl. No.: 14/613,944

(22) Filed: Feb. 4, 2015

(51) Int. Cl.

| | |
|---|---|
| ***B65D 21/032*** | (2006.01) |
| ***B65D 21/02*** | (2006.01) |
| ***B65D 25/28*** | (2006.01) |
| ***B65D 25/24*** | (2006.01) |
| ***B65D 25/48*** | (2006.01) |
| ***B65D 85/00*** | (2006.01) |

(52) U.S. Cl.
CPC ..... *B65D 21/0204* (2013.01); *B65D 25/24* (2013.01); *B65D 25/2826* (2013.01); *B65D 25/48* (2013.01); *B65D 85/70* (2013.01)

(58) Field of Classification Search
CPC ..... B65D 21/0204; B65D 21/022; B65D 21/0217; B65D 21/0215; B65D 21/0212; B65D 21/0209; B65D 1/0261; B65D 1/0284; B65D 25/24
USPC ..... 215/10, 398
See application file for complete search history.

(56) References Cited

U.S. PATENT DOCUMENTS

| | | | | | |
|---|---|---|---|---|---|
| D202,660 | S | | 10/1965 | Dike | |
| 3,214,052 | A | | 10/1965 | Dike | |
| 3,270,922 | A | * | 9/1966 | Schmidt | B65D 21/0231 206/509 |
| 3,658,204 | A | | 4/1972 | Bottger | |
| 3,746,200 | A | | 7/1973 | Flider | |
| 4,412,633 | A | * | 11/1983 | Guerrazzi | B65D 1/20 215/398 |
| 4,805,793 | A | * | 2/1989 | Brandt | B65D 21/0231 206/509 |
| 5,669,526 | A | | 9/1997 | Keyfauver | |
| 5,823,345 | A | | 10/1998 | Nask | |
| D401,188 | S | | 11/1998 | Shickle | |
| 6,230,892 | B1 | | 5/2001 | Przytulla | |
| D446,494 | S | | 8/2001 | Martin | |
| 6,352,167 | B1 | | 3/2002 | Yu | |
| 6,588,612 | B1 | | 7/2003 | Dorn | |
| 6,719,161 | B1 | | 4/2004 | Craig | |
| 7,040,509 | B2 | | 5/2006 | McLelland | |
| D687,712 | S | | 8/2013 | Juna | |
| D692,304 | S | | 10/2013 | Cota Castillo | |
| 2006/0131334 | A1 | | 6/2006 | Carlson | |
| 2007/0045213 | A1 | | 3/2007 | Voss | |
| 2007/0114200 | A1 | | 5/2007 | Lane | |
| 2009/0266782 | A1 | | 10/2009 | Lane | |
| 2011/0204051 | A1 | | 8/2011 | Pawl | |
| 2011/0220530 | A1 | | 9/2011 | Weissbrod | |
| 2012/0055833 | A1 | | 3/2012 | Thibault | |
| 2012/0261297 | A1 | | 10/2012 | Eble | |
| 2013/0213846 | A1 | | 8/2013 | Hendrickson | |

* cited by examiner

*Primary Examiner* — Stephen Castellano
(74) *Attorney, Agent, or Firm* — Stephen D. Carver

(57) ABSTRACT

Molded plastic fuel containers comprise a plastic, with a pair of sides and gently inclined, integral front and rear faces. An integral handle spanning the top of the body extends over and between front and rear faces. A channel-like trough is defined at the bottom, beneath spaced-apart bottom portions. The trough is configured to snugly receive a handle when units are stacked vertically. Front portions of the handles and each trough are wider than corresponding rears. When a handle mated to and seated within a trough during stacking, stability is increased because both lateral (i.e., side-to-side) movements and linear (i.e., forward and rearward) movements are resisted by the locking action of the mating process.

3 Claims, 10 Drawing Sheets

STACKABLE, STABILIZED FUEL CONTAINERS

BACKGROUND OF THE INVENTION

1. Field of the Invention

The present invention relates generally to liquid containers. More particularly, the present invention relates to stable, molded plastic fuel containers adapted to be stacked together when stored or shipped.

2. Description of the Related Art

Molded plastic containers are widely used for storing liquids such as water, fuels, beverages, industrial and agricultural chemicals and the like. Fuel containers of widely varying shapes and sizes are known. Typical containers include some form of hollow receptacle, often cylindrical, that may be integral with a pouring spout or other features. Plastic containers vary in capacity, from common milk bottles that hold one-half or one gallon, to larger fuel tanks with a capacity of five gallons or more.

It is desirable that containers be stable, whether during use or in storage. Obviously containers holding flammable liquids such as gasoline, kerosene, diesel fuel or the like must be designed to be as safe as possible, necessitating designs that promote stability and prevent spillage. For a variety of reasons such as shipping costs, it is also desirable to provide containers that are easily stacked to reduce volume, and which are just as easily unstacked when deployed for use. Concurrently, adequate handles and pouring sports must be convenient, reliable, and safe to use. Handling of heavy, filled or partially filled containers, particularly where combustible fuels are stored must be convenient and non-cumbersome. Various aesthetic visual characteristics are desirable as well.

Stackable bottles or containers are well known in the art. Most designs seek to nest a portion of one container in a receptive region or structure defined in the bottom of a companion container.

For example, U.S. Pat. No. 5,823,345 issued Oct. 20, 1998 shows a modular, stackable receptacle for pool chemicals that includes an upper cover and a lower container portion. The cover includes a continuous rectilinear sidewall having a latch ring, and the upper surface of the cover includes a pour spout which receives a closure cap. The upper surface of the cover also includes a raised crown portion which is coplanar with the closure cap. Both the closure cap and the crown portion have stacking and aligning projections which cooperate with respective recesses formed in the bottom wall of the container portion, which recesses facilitate stable stacking of the receptacles, one atop another.

U.S. Pat. No. 6,230,892 issued May 15, 2001 discloses a stackable, re-usable container with at least one filler and drain opening in the top and with a circumferential upper and lower stacking ring. The upper stacking ring has a slightly larger diameter than the lower stacking ring so that, when stacked one container atop the other, the lower stacking ring of the upper container fits into the recess in the upper stacking ring of the barrel underneath and is snugly centered therein by the vertically protruding circular flange.

U.S. Pat. No. 6,588,612 issued Jul. 8, 2003 discloses a plastic container including side portions having protrusions and/or depressions which nest with one of matching protrusions and depressions of a second container, and with the bottom portion including depressions which nest with the pouring spout and handle of a second container.

U.S. Pat. No. 6,719,161 issued Apr. 13, 2004 discloses a storage container for liquids. A see-through sight visibly exposes the level of product in the container. The container has a wide and stable bottom for stability, and holes in corners to secure a bungee cord. The containers can be stacked for easy storage. The spout is stored in the handle to prevent contamination and to keep a user's hands away from the contents of the container.

U.S. Pat. No. 7,040,509 issued May 9, 2006 discloses a container for storage and dispensing of paint. A unitary, molded plastic container body has an annular neck which is externally threaded and which defines the opening through which contents are dispensed. A dispensing spout is positioned within the neck. The dispensing spout includes two threaded portions, one which engages the neck portion and the other which receives a removable closing cap. The cap is constructed and arranged to close the container opening. A transporting handle is provided and is attached directly to the dispensing spout such that the cap, spout, and handle can be provided as a sub-assembly for threaded engagement onto the container body.

U.S. Pat. Application No. 20060131334 published Jun. 22, 2006 discloses a stackable container for storing and dispensing liquid. A main body comprising a fill port that includes a fill portion and an offset portion wherein the fill portion and offset portion are offset from the main body to provide clearance for filling.

U.S. Pat. Application No. 20070045213 published Mar. 1, 2007 discloses a blow molded, plastic container including a top portion and a bottom portion. Side portions interconnect the top and bottom portions. A pouring spout on one side of the top portion is in the form of a first upward projection, and a second upward projection on the opposed side of the top portion. A handle on the side portion opposed to the pouring spout, and spaced depressions in the bottom portion which nest into the upward projections to form a nested assembly of containers.

U.S. Pat. Application No. 20070114200 published May 24, 2007 discloses a stackable bottle having a storage chamber defined by spaced upper and lower surfaces and planar sidewalls. When stacked, an upper, conical ceiling of a lower bottle mates with a lower convex recess in an upper bottle. Means are provided for interlocking the sides and upper and lower surfaces of the bottles when stacked.

U.S. Pat. Application No. 20110204051 published Aug. 25, 2011 discloses a storage container system including a plurality of containers of various sizes and having interlocking features for minimizing shipping and storage space for the containers. Each container has an open interior, a top surface, a bottom surface, a front surface, a rear surface, and two side surfaces. A closure device is disposed on the top surface of the container for allowing access to the open interior of the container, and the bottom surface defines a bottom indent pocket for interlocking with the closure device of another container. A handle is disposed on the front surface of the container, and the rear surface defines a rear indent pocket for interlocking with the handle of another container.

U.S. Pat. Application No. 20110220530 published Sep. 15, 2011 discloses a stackable container for storing welding electrodes. A container body and a container cap are constructed via thermoplastic injection molding. The container is constructed with walls that define an interior region and complementary upper and lower surfaces.

U.S. Pat. Application No. 20120055833 published Mar. 8, 2012 discloses an ergonomic, stackable watering can for watering plants and flowers. The can comprises a tapered reservoir having a peripheral wall, a bottom and a top opening defining a top edge of the wall, a spout extending from the reservoir, and a handle mounted to the reservoir over a tapered stem which is mounted to the bottom of the reservoir. The peripheral wall further includes an enlargement for receiving a portion of the spout of a similar watering can when the watering cans are assembled in a stack. The handle of a first watering can is inserted in the stem portion of a second watering can when two such watering cans are stacked.

U.S. Pat. Application No. published Oct. 18, 2012 discloses another stackable container. The container comprises a recessed portion and a complimentary top and base which allow for a stack of such containers to be arranged wherein the neck of a lower container is placed within the recessed portion of an upper container, and the base of the upper container contacts the top of the lower container.

U.S. Pat. Application No. 20130213846 published Aug. 22, 2013 discloses a modular, interlocking container suitable for multiple uses. Vertical and horizontal interconnectivity are achieved through interlocking mechanisms. Each modular unit slide-locks with other units to form strong wall and building structures that can be filled with natural earth, sand or other such materials, thereby forming a sturdy structure without the use of mortar, and can adapt to uneven base surfaces typically found in natural terrain.

Other diverse designs of lesser significance to the invention include U.S. Pat. No. 3,658,204 issued Apr. 25, 1972 that discloses a container arrangement for two-component varnishes wherein a large and smaller vessel mechanically interact. The large container comprises a recess corresponding to the shape and size of the smaller, companion container which is coupled to the larger. An open vessel, intended for use as a mixing vessel, is arranged to fit around the large and the small container in the area of the recess.

U.S. Pat. No. 5,669,526 issued Sep. 23, 1997 depicts a spill proof paint can that includes a hollow, cylindrical container, a circular top, and a pouring spout. The lid has a depression with an aperture shape of the container, so that when the lid is placed on the container the lid enters the through the aperture of the container and prevents relative rotation while providing a seal. The pouring spout is disposed in the depression of the lid and is in fluid communication with the aperture of the depression on the lid, so that paint contained in the container can be readily poured.

U.S. Pat. No. 6,352,167 issued Mar. 5, 2002 discloses a combined tool box and fuel tank, that includes a structural combination for consolidated storage. The tool box stands independently in opening and closing operation, which is easy for the operator to take off and put back the tool, and the fuel tank is designed to be separated from the combination for independent use.

When multiple containers are stacked together, the upper surface of one container engages the lower surface or structure of an adjacent container, thereby restraining movements between the containers. However, an inefficient configuration of upper and lower interlocking surfaces may result in unusually large displacements between adjacent containers. Excessive shifting around can result on damages, as frictional wear occurs between abutting surfaces. Bulky or large plastic containers present another difficult problem for stackability and handling because of structural flexure. Repeated deformations of the walls of a fuel container, for example, can eventually result in cracks or product breakage, particularly when the unit is subject to use outdoors, and it is exposed to ultraviolet light and low temperatures.

BRIEF SUMMARY OF THE INVENTION

The fuel containers of this invention are highly stable, convenient for use and manipulation, and are stackable and testable as well.

Each container comprises a plastic, preferably molded body with a pair of sides and gently inclined, integral front and rear faces. A handle assembly spans the top of the body, extending over and between the front and rear faces. The body comprises a channel-like trough beneath it, between twin bottom portions. The trough is configured in a complimentary fashion to the geometry of the handle so it may snugly receive a handle of a companion container when units are vertically stacked. A front handle portion is slightly wider than the rear handle portion, and the front of each trough is similarly widened. When a handle is seated within a trough during stacking, stability is increased because both lateral (i.e., side-to-side) movements and linear (i.e., forward and rearward) movements are resisted by the locking action of the mating process.

A fundamental of the present invention is to provide a highly stackable and stable container that is ideal for use with fuels such as gasoline, diesel fuel, kerosene, or the like.

Another basic object is to provide a stable, spill proof container.

A related object of the present invention to provide a plastic container which is stackable.

It is a further object of the present invention to provide a stackable, plastic container as aforesaid which has desirable commercial characteristics, such as ease of use, convenience in stacking, and pleasing aesthetic features.

It is also an object of this invention to provide a compact and efficient container for storing and dispensing liquids, particularly fuels and the like.

Further, an important object of this invention to provide fuel containers of the character described that can be stacked on top of each other, or spaced-apart laterally, to minimize storing or shipping space.

A related object is to provide containers of the character described wherein stacking is enabled through a contiguous handle disposed on the unit top, that mates within a trough in the units' bottom.

It is yet another object of this invention to provide a receptacle assembly of the character described which can be readily filled with product and capped on an assembly line.

It is a further object of this invention to provide a receptacle assembly of the character described which can be manipulated with only one hand to dispense product.

Another object is to provide containers designed to be stable and stackable, whose basic design results in a highly dependable and structurally strong unit, whether configured in one-half, one, two, five gallon or bigger sizes.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
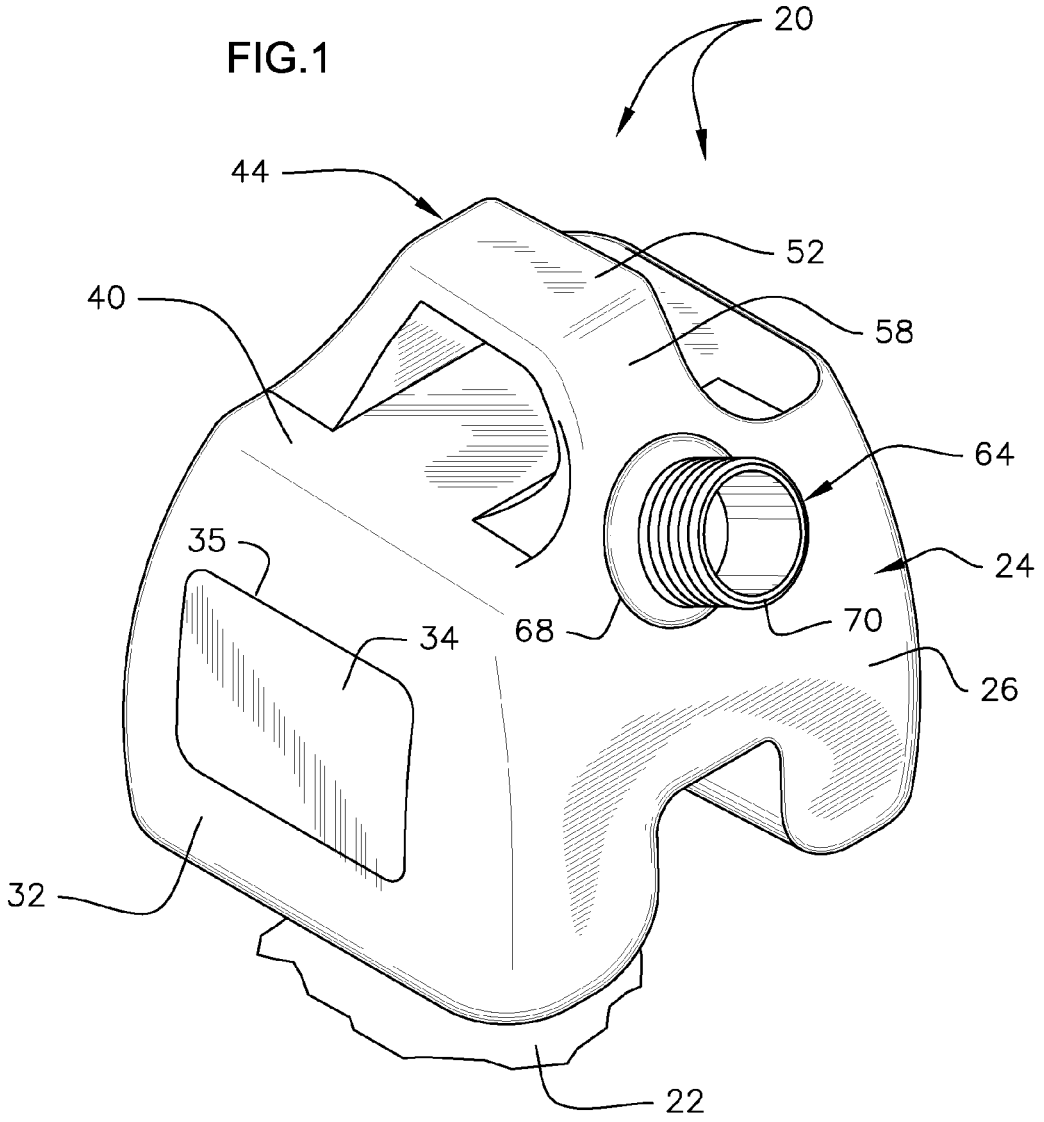
FIG. 1 is a frontal isometric view of a Stackable, Stabilized Fuel Container constructed in accordance with the best mode of the invention.
Figure 2:
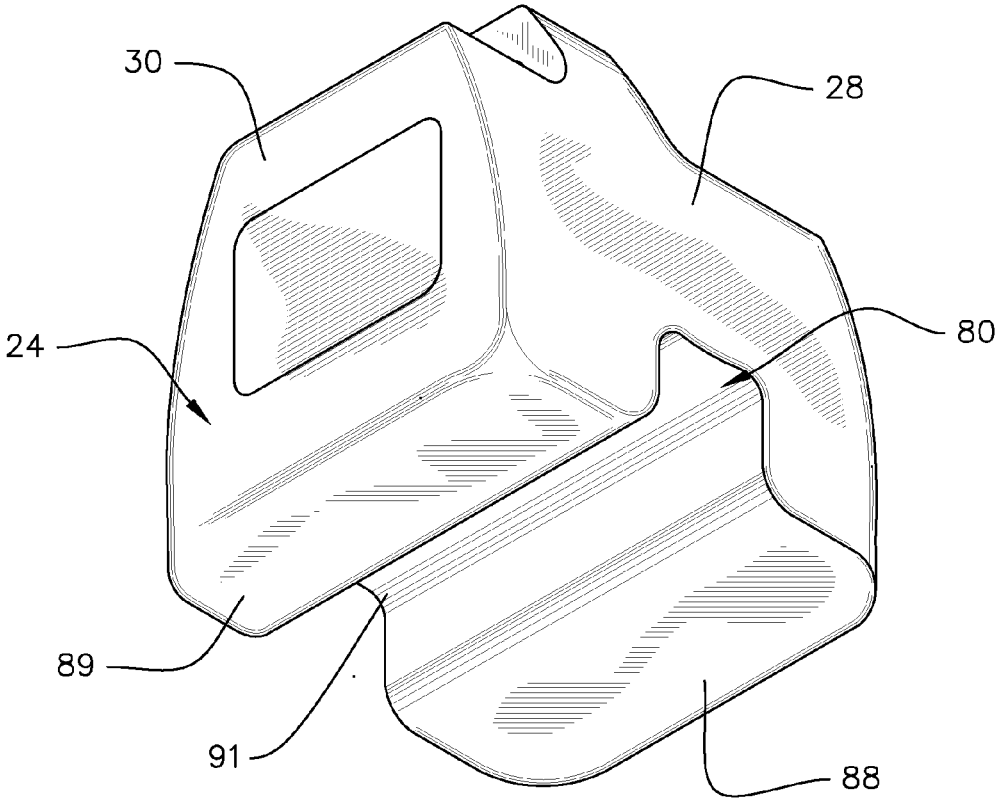
FIG. 2 is a rear, bottom isometric view thereof.
Figure 3:
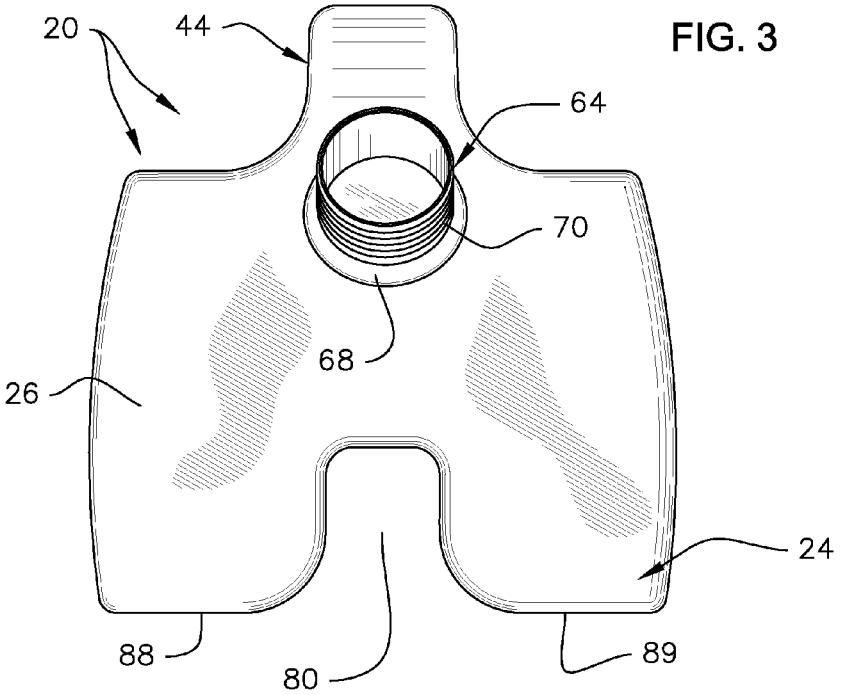
FIG. 3 is a front elevational view thereof.

With initial reference directed now to FIGS. 1-8 of the appended drawings, A Stackable, Stabilized Fuel Container, constructed in accordance with the best mode of my invention, as been generally designated by the reference numeral 20. Container 20 has been designed to be highly stable, and its stance or presentation upon a lower supporting horizontal surface 22 (FIG. 1) makes it difficult to tip or turn over. Moreover, units may stack on top of each other vertically in a stable manner, forming a vertical column when multiple units are stacked together vertically and horizontally proximate one another. In this regard, the container comprises an integral handle portion discussed below, which is adapted to facilitate nesting or mating within a similarly configured, channel-like trough integrally molded into the bottom regions of the plastic body.

The main body 24 of the container 20 is generally in the form of a parallelepiped, although in the best mode it is generally cubicle. The body 24 comprises a slightly inclined front face 26 that is integral with an oppositely inclined rear 28 (i.e., FIG. 2). The front face 26 and the rear face 28 are connected by and integral with a left sidewall 30 (FIGS. 2, 6) and an integral, spaced-apart right sidewall 32 (i.e., FIGS. 1, 5). Each curved, but substantially vertically oriented sidewall preferably comprises a generally rectangular, substantially flat central surface 34 visibly designed to be distinctive by a boundary area 35. Surface 34 may receive a suitable gummed label or the like during packaging.

Figure 4:
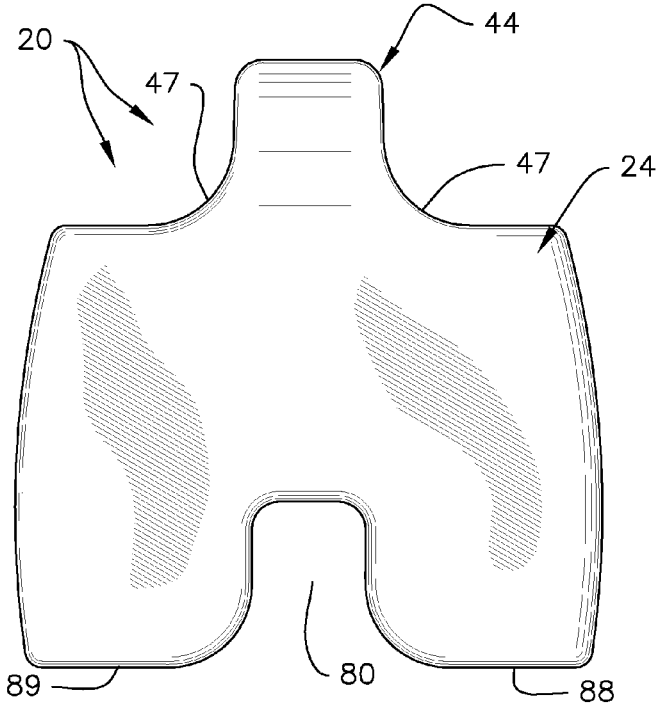
FIG. 4 is a rear elevational view thereof.
Figure 5:
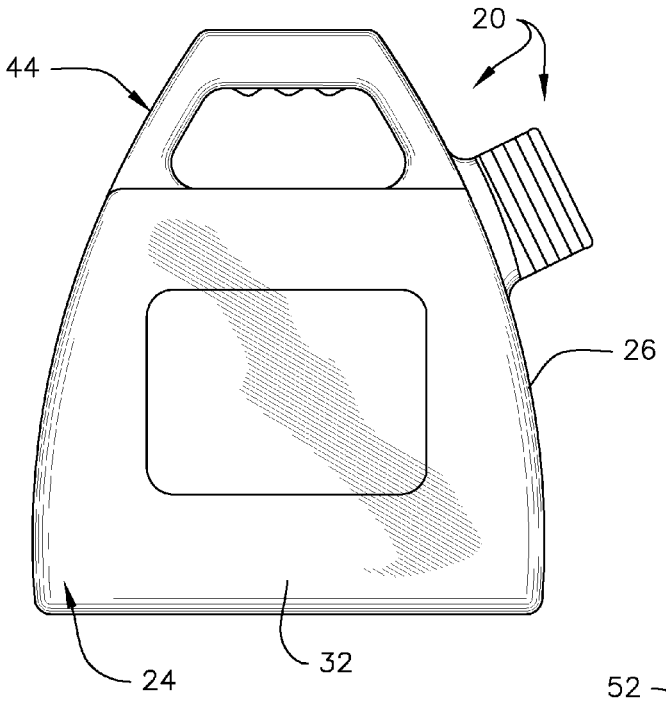
FIG. 5 is a left side elevational view thereof.
Figure 6:
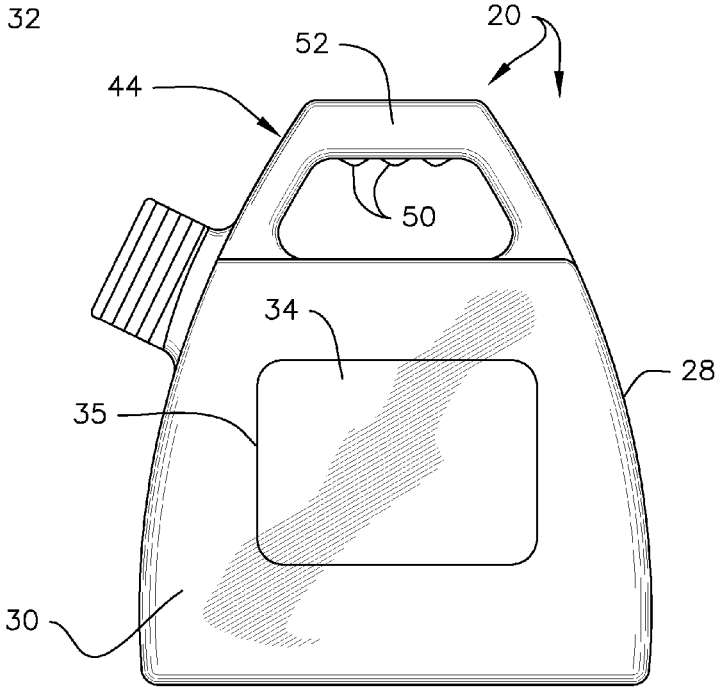
FIG. 6 is a right side elevational view thereof.
Figure 7:
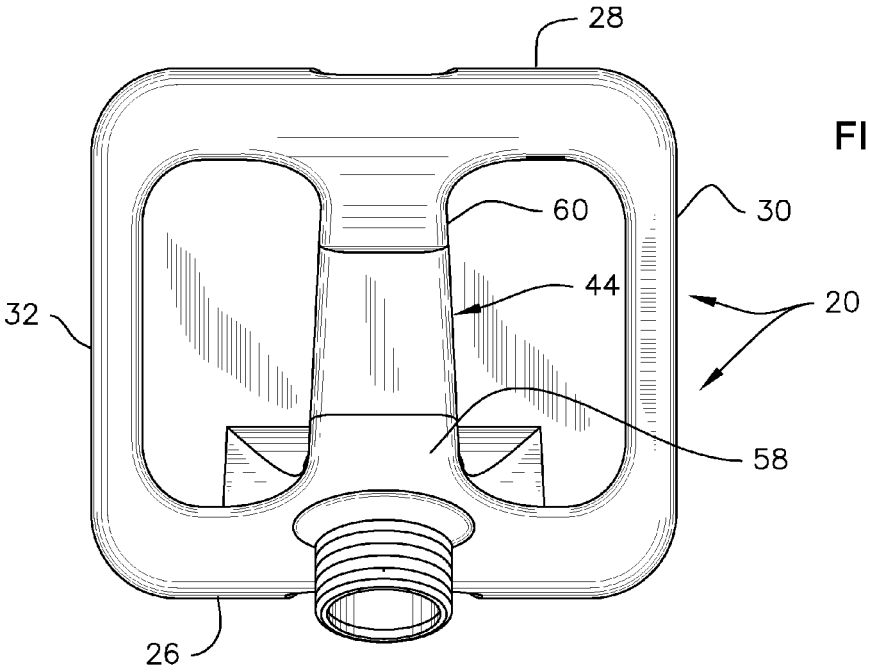
FIG. 7 is a top plan view thereof.
Figure 8:
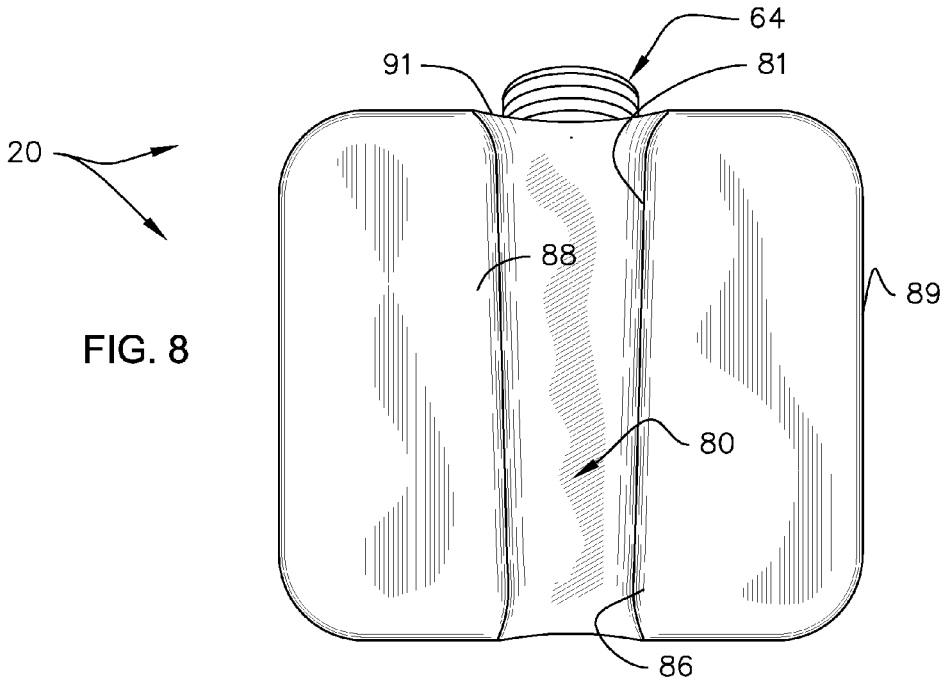
FIG. 8 is a bottom plan view thereof.
Figure 10:
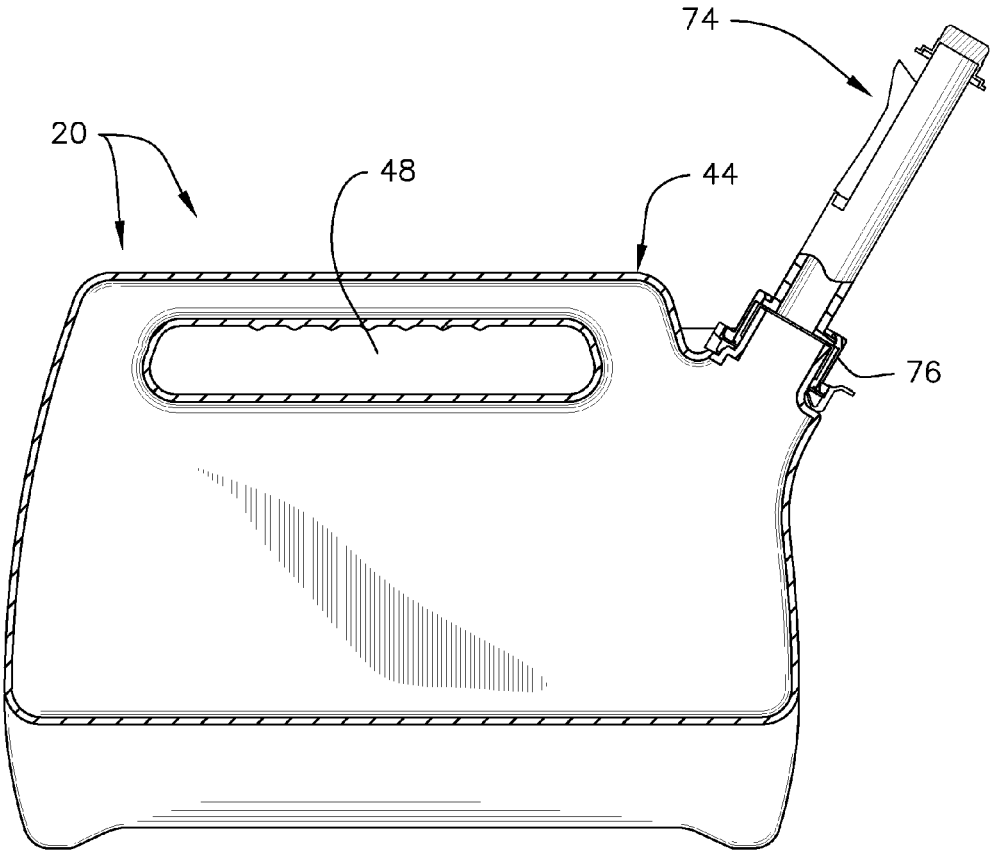
FIG. 10 is a partially fragmentary, sectional view taken generally along line 10-10 in FIG. 9.
Figure 11:
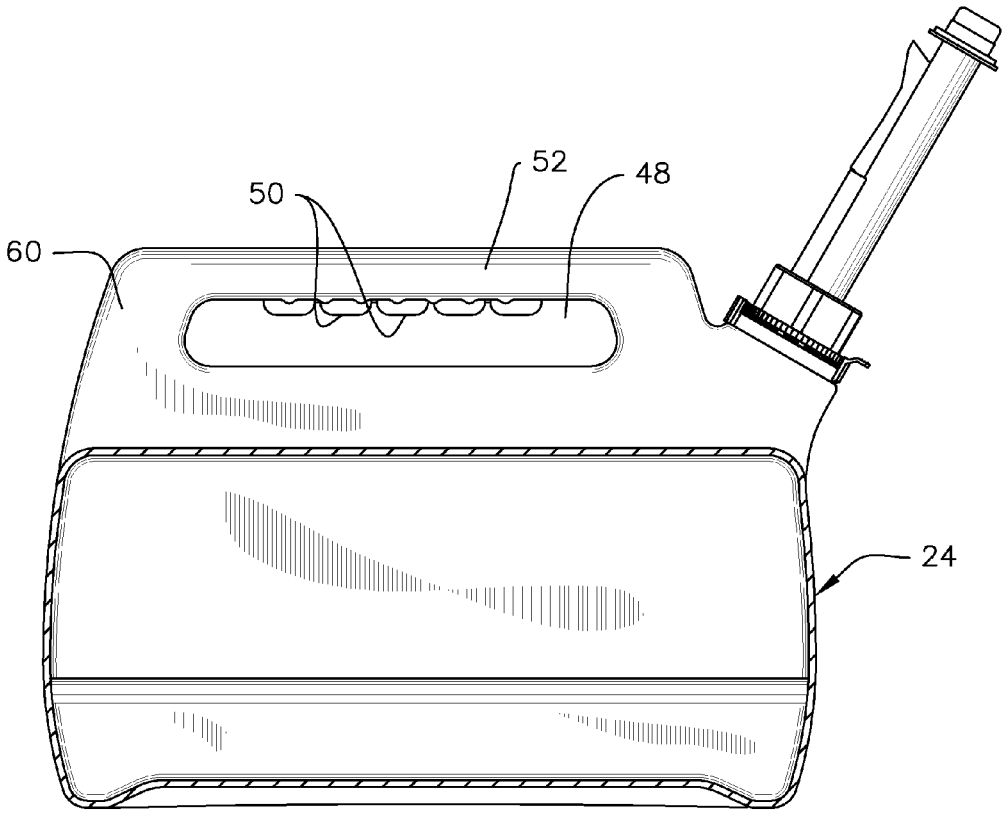
FIG. 11 is a partially fragmentary, sectional view taken generally along line 11-11 in FIG. 9.
Figure 12:
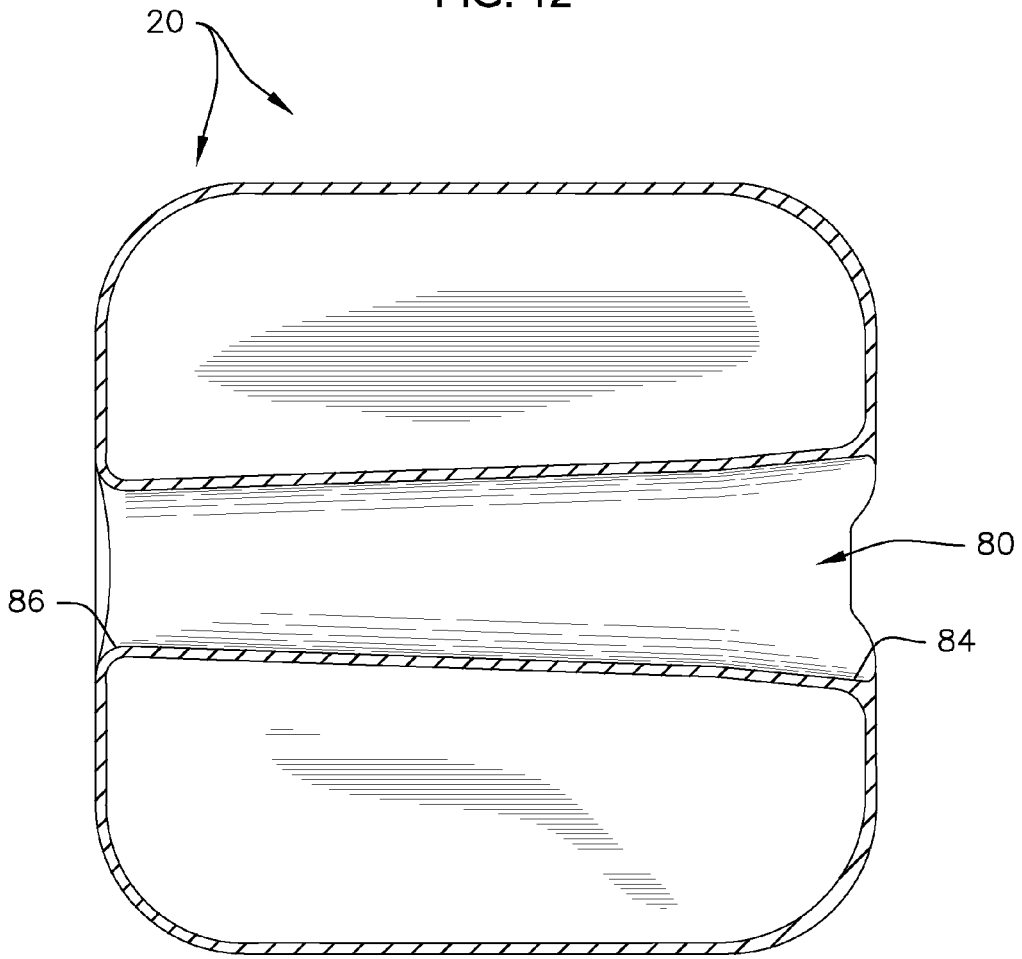
FIG. 12 is a partially fragmentary, longitudinal sectional view taken generally along line 12-12 in FIG. 9; and, FIG. 13 is a diagrammatic, isometric view showing how numerous containers of descending sizes constructed in accordance with the invention may be stacked for display or stowage.

Body 24 comprises an upper top 40 that is substantially horizontal. Top 40 extends across and between the front face 26, rear face 28, and the integral sidewalls 30, 32. It will be noted that an arch-like handle portion, generally designated by the reference numeral 44, spans the top 40, extending generally between the front face 26 and rear 28 over top 40. There is a substantially rectilinear open grasping access portion 48 (FIG. 10) defined between handle portion 44 and the top 40 through which a user may place his or her hand to grasp the handle and manipulate the container 20. Preferably there are a plurality of raised, spaced apart nibs 50 projecting beneath the handle grip 52 (FIGS. 1, 11) for making contact with the users fingers to frictionally aid the grip. The grip 52 of the handle portion 44 integrally extends substantially horizontally between inclined front and rear handle portions 58, 60 respectively. Preferably the front handle portion 58 is slightly wider than the rear handle portion 60 for stability purposes when containers are stacked, as described below. However, the rear portion of the handle could be wider than the front portion and the locking and stability goals described below would be the same, providing the trough is similarly configured. Preferably the elongated handle assembly edges 47 (FIG. 4) are gently radiused (FIG. 4).

Figure 9:
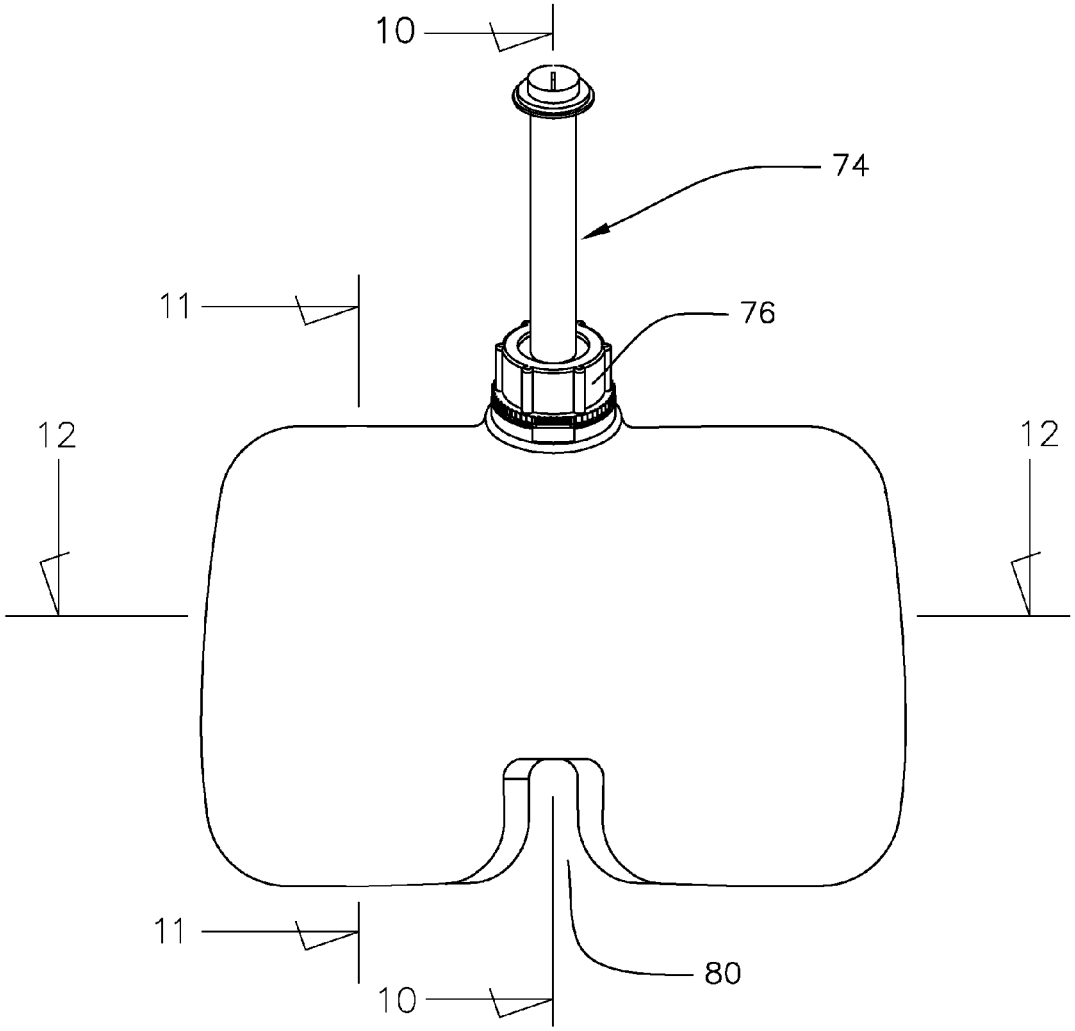
FIG. 9 is a front perspective view thereof, showing an optional spigot.

The front handle portion 58 gently merges with the front face 26 of the body 24. A dispensing socket 64 assembly is centered at the front of the body, occupying portions for the front face 26 and the front handle portion 58. The socket assembly 64 is integral with body 24. Preferably the socket assembly 64 comprises a reinforcing ring 68 molded into the body, with an integral, threaded tube portion 70 concentrically projecting from the center of the ring 68. As is known in the art, a conventional spigot 74 (FIG. 9) may be attached by screwing to socket assembly 64. The threaded socket 64 is engaged by a suitable sealing nut 76 (i.e., FIGS. 9-10) that includes a sealing flange portion and suitable gaskets to establish a sealed connection for dispensing.

There is an elongated channel-like trough 80 defined in the bottom region of the body 24 (i.e., FIGS. 3, 4, 8, 12). The shape of the rough is complimentary to the external shape of the handle portion 44. Although generally rectangular (i.e., as viewed in FIG. 8) the front region 84 is slightly wider than the rear region 86. (Alternatively, if the handle is similarly configured, the rear portion could be wider than the front portion.) Further, inner corners 81 and lowermost bottom edges 83 are gently radiused. A bottom of the container 20 is formed by twin, spaced apart legs having lowermost surfaces 88, 89 (i.e., FIGS. 2, 8) that are disposed between the trough 80. These twin legs promote stability, whether containers are stacked or unstacked. Preferably, the front trough region 84 also includes a forwardly flared region 91 (FIGS. 2, 8) that provides clearance space for the spigot assemblies of stacked containers (i.e., FIG. 13).

Figure 13:
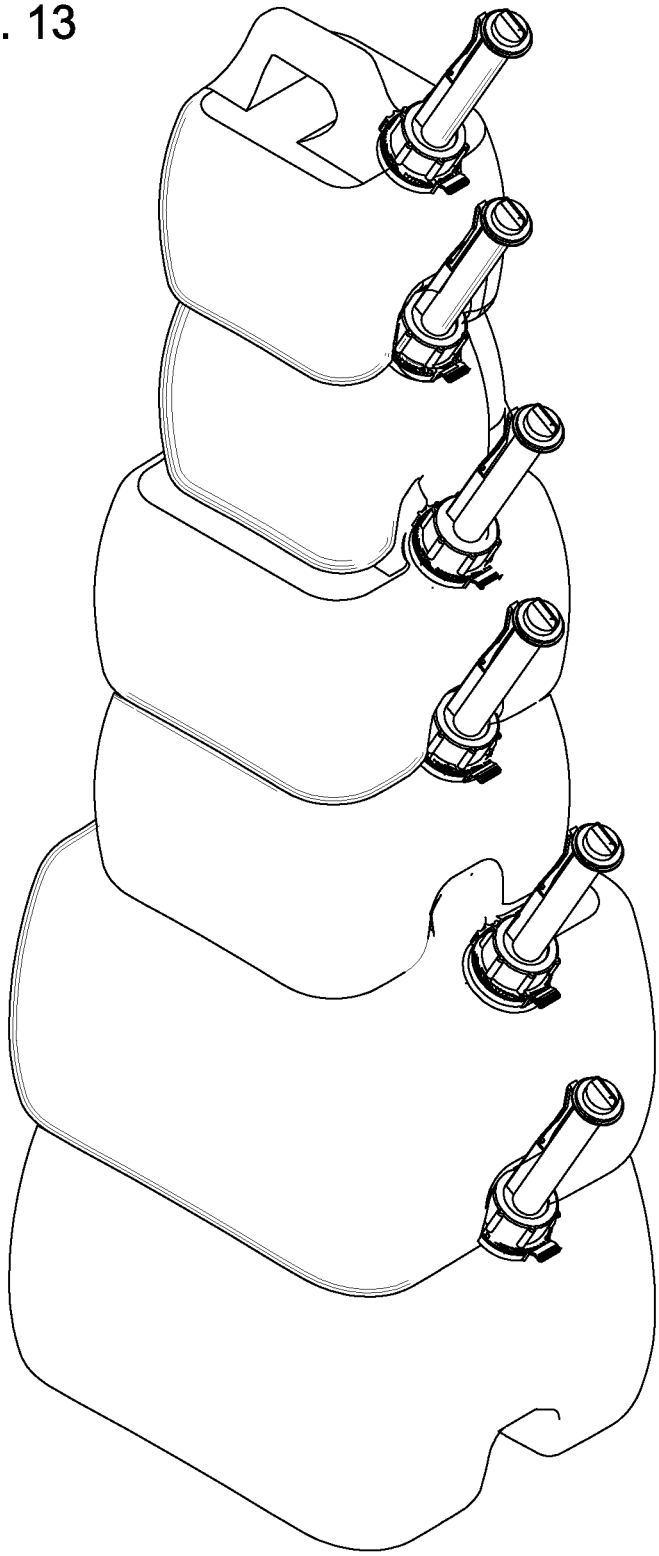

If a pair of containers 20 are stacked (i.e., FIG. 13), it will be noted that each trough 80 snugly receives and mates to the handle of a container beneath it. Units can be stacked whether they are similarly sized or not. In FIG. 13 is is seen that smaller containers can gradually be placed atop one another for display purposes. As mentioned earlier, the front portion of the handles 44 is wider than the rear, as reflected by the dimensions of the trough 80, so neither linear displacements nor lateral (i.e., side-to-side) displacements of twin stacked containers is likely. Because of the frictional fit of the handle 44 that is snugly received within the trough, stability is promoted.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A stackable, stabilized container for liquids, the container comprising:

a body comprising an inclined front face and an opposite, inclined rear face that is integral with the front face;

a pair of integral spaced apart, curved sidewalls that are substantially vertical, the sidewalls extending between the front and rear faces;

a substantially horizontal upper top extending between the sidewalls and the front and rear faces;

an arch-like handle spanning the top, extending generally between the front face and the rear face;

a substantially open grasping access portion defined between the handle and the top;

the handle comprising a front handle portion and a rear handle portion, one of the front and rear handle portions being slightly wider than the other;

a dispensing socket assembly centered at the front of the body proximate the handle for receiving a spigot;

an elongated channel-like trough defined in the bottom of the body that is shaped to receive and fit with a handle of another container during stacking, the trough comprising a front portion and a rear portion, one of the front and rear trough portions being slightly wider than the other to mate with a handle; and, a container bottom formed by twin legs disposed between the trough with spaced apart lowermost surfaces.

2. The container as defined in claim 1 wherein the front handle portion gently merges with the front face of the body.

3. The container as defined in claim 1 wherein the front trough region includes a forwardly flared region that provides clearance space for said dispensing socket and spigot assemblies of stacked containers.

* * * * *